US005694906A

United States Patent [19]

Lange et al.

[11] Patent Number: 5,694,906

[45] Date of Patent: Dec. 9, 1997

[54] FUEL INJECTION SYSTEM FOR A COMBUSTION ENGINE

[75] Inventors: Jörg Lange, Eberdingen; Herbert Gladigow, Magdeburg, both of Germany

[73] Assignees: Robert Bosch GmbH, Germany; Texas Instruments Holland, B.V., Netherlands; Ulev GmbH, Germany

[21] Appl. No.: 693,271

[22] PCT Filed: Dec. 20, 1995

[86] PCT No.: PCT/DE95/01826

§ 371 Date: Aug. 16, 1996

§ 102(e) Date: Aug. 16, 1996

[87] PCT Pub. No.: WO96/20342

PCT Pub. Date: Jul. 4, 1996

[30] Foreign Application Priority Data

Dec. 23, 1994 [DE] Germany ..... 44 46 242.5

[51] Int. Cl.[6] ..... F02M 53/06; F02M 69/04; F02M 31/18

[52] U.S. Cl. ..... 123/549; 123/533

[58] Field of Search ..... 123/549, 543, 123/545, 547, 557, 531, 533

[56] References Cited

U.S. PATENT DOCUMENTS

| | | | |
|---|---|---|---|
| 4,325,341 | 4/1982 | Yamauchi et al. | 123/549 |
| 4,572,146 | 2/1986 | Grunwald et al. | 123/549 |
| 4,604,975 | 8/1986 | Frey et al. | 123/549 |
| 4,627,405 | 12/1986 | Imhof et al. | 123/549 |
| 4,676,216 | 6/1987 | Ohsawa et al. | 123/533 |
| 5,129,381 | 7/1992 | Nakajima | 123/533 |
| 5,156,133 | 10/1992 | Sugimoto et al. | 123/533 |
| 5,218,943 | 6/1993 | Takeda et al. | 123/549 |
| 5,255,658 | 10/1993 | Hoffer et al. | 123/531 |

FOREIGN PATENT DOCUMENTS

| | | |
|---|---|---|
| 1 085 248 | 9/1980 | Canada . |
| DE 28 43 534 | 4/1979 | Germany . |

OTHER PUBLICATIONS

SAE article 390710 "Cold Start Performance of an Automotive Engine Using Prevaporized Gasoline".

*Primary Examiner*—Marguerite McMahon
*Attorney, Agent, or Firm*—Kenyon & Kenyon

[57] ABSTRACT

A fuel injection system for a combustion engine having an injection valve with a fuel vaporizer into whose inlet orifice fuel can be injected from the injection valve and out of whose outlet orifice a fuel stream is discharged, and having an air supply system that supplies air to the fuel vaporizer for mixing with the fuel stream. To improve the fuel delivery from the fuel vaporizer, the air supply system has an air blow-out device mounted in the area of the outlet orifice of the fuel vaporizer through which the air to be added to the fuel stream is supplied to the fuel stream discharged from the fuel vaporizer.

12 Claims, 3 Drawing Sheets

FUEL INJECTION SYSTEM FOR A COMBUSTION ENGINE

FIELD OF THE INVENTION

The invention concerns a fuel injection system for an internal combustion engine.

BACKGROUND INFORMATION

A fuel injection system having an injection valve and a fuel vaporizer connected to it is already known from SAE article 930710 "Cold start performance of an automotive engine using prevaporized gasoline." The fuel vaporizer there consists of an electrically heated tube into which the fuel is injected from the injection valve.

To bring the stream of fuel in contact with the inside wall of the tube so the fuel will be vaporized, three compressed air nozzles are provided in the connection area between the fuel vaporizer and the injection valve, so that one nozzle injects air radially to the fuel to deflect the stream of fuel while the two other nozzles inject the air tangentially to cause the deflected fuel stream to rotate, so the fuel stream moves essentially in a spiral line through the electrically heated vaporizer tube.

German Patent Application NO. DE 2,843,534 describes another fuel injection system with an injection valve, where the outlet channel connected to the injection orifice of the injection valve has an electric heating element to vaporize the fuel sprayed onto it. An air jet opens into the area of the outlet channel between the injection orifice of the injection valve and the heating element, and by utilizing the pressure gradient in the intake tube, the air jet receives air from the intake tube which is then added to the fuel stream from the injection valve.

Use of fuel vaporizers in fuel injection systems has proven successful in reducing pollution emissions when starting up a combustion engine. Such a reduction in pollutant emissions is necessary until the catalyst integrated into the exhaust system of the combustion engine has reached its operating temperature, when it becomes fully functional. However, as soon as the catalyst has been heated to its operating temperature, prevaporization of the fuel is no longer necessary, so the fuel vaporizer can be turned off in normal operation of the combustion engine. However, if the fuel vaporizers that are connected directly to the injection valve are not heated electrically, problems occur in producing the fuel-air mixture, because the fuel vaporizer impairs the fuel stream produced by the injection valve and thus interferes with fuel delivery.

SUMMARY OF THE INVENTION

The system according to the present invention has the advantage in comparison with the prior art that the vapor jet leaving the fuel vaporizer is shaped by the supply of air in the area of the outlet orifice of the fuel vaporizer, and furthermore improved atomization of the ejected fuel stream is achieved while the fuel vaporizer is not operating, i.e., the fuel vaporizer is not heated.

It is especially advantageous that appropriate guidance of the air to be mixed with the fuel stream produces a suction effect that greatly improves fuel delivery from the vaporization area of the fuel vaporizer. Especially suitable nozzles include annular gap nozzles and nozzles with several orifices arranged around the outlet orifice of the fuel vaporizer through which air can be injected essentially radially into the fuel stream leaving the fuel vaporizer. Thanks to the suction effect achieved according to this invention, fuel deposits on the inside walls and on the vaporizer structure can be prevented especially in an unheated fuel vaporizer.

It is especially advantageous if the blow-out orifice is designed so its effective cross section determines how much air is to be added to the fuel stream. As an alternative, the air inlet system may be connected to an idling air regulator of a combustion engine, so all the idling air is added to the fuel stream through the air supply system.

For even better prevention of fuel deposits with unheated fuel vaporizers, it is advantageous to also provide an air supply to the inlet orifice of the fuel vaporizer in addition to the air supply in the area of the outlet orifice, thus purging the vaporizer area and the vaporizer structure.

BRIEF DESCRIPTION OF THE DRAWINGS

In the various FIGS., corresponding parts are marked with the same reference numbers.

DETAILED DESCRIPTION OF THE DRAWINGS

Figure 1:
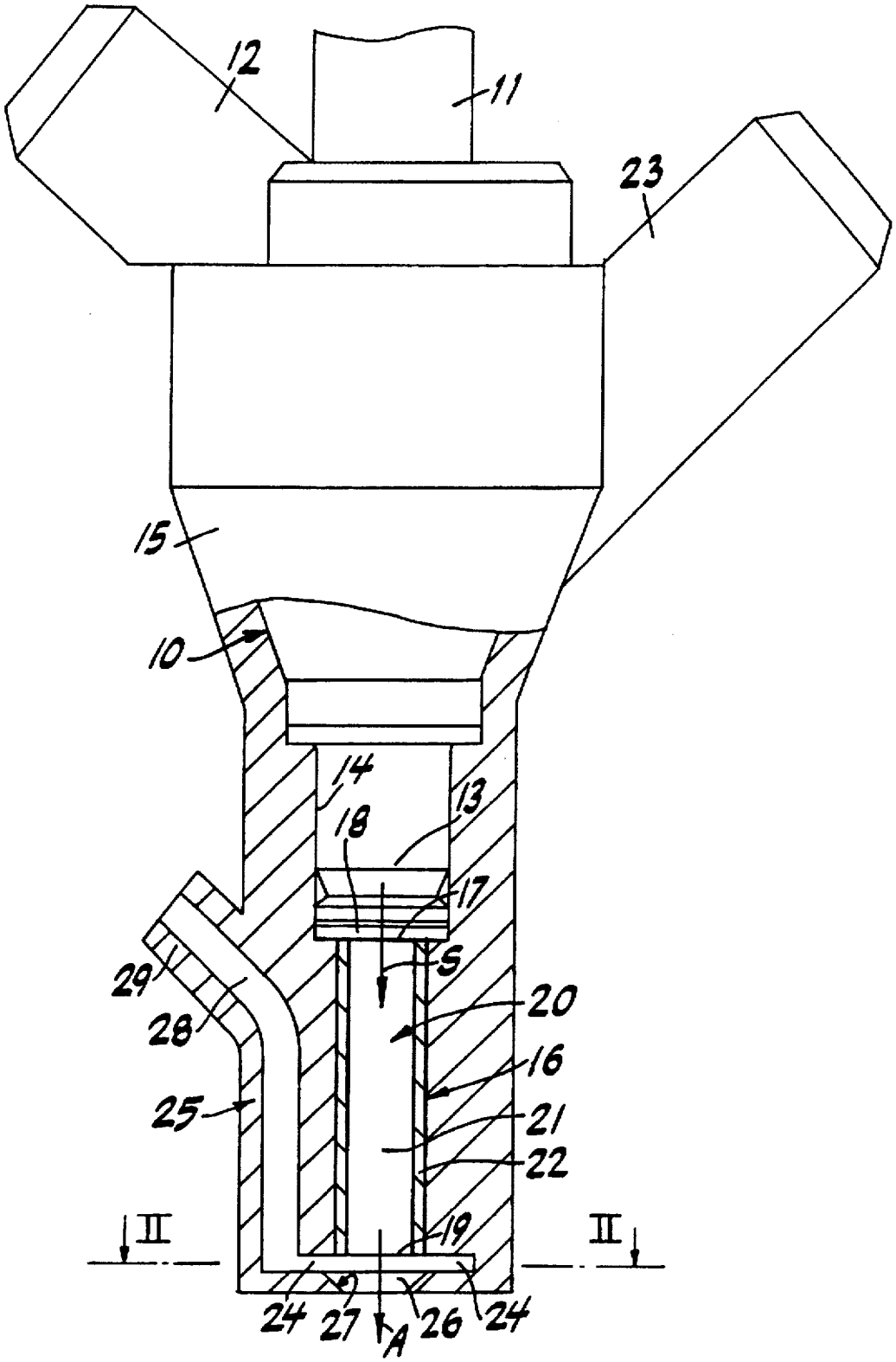
FIG. 1 shows a partial sectional view in a schematic diagram of a fuel injection system according to this invention.

FIG. 1 shows a fuel injection system for a combustion engine with an injection valve 10 that can receive fuel under pressure from a pressurized fuel source (not illustrated) through a fuel supply connection 11 and can be connected to an electric or electronic engine control unit (not illustrated) via a connecting section 12. A spray hole section 13 of injection valve 10 is provided in a cylindrical recess 14 in a housing 15.

A fuel vaporizer 16 is accommodated in housing 15 behind spray hole section 13 at some distance from spray hole section 13 in spraying direction S, where an inlet orifice 17 of fuel vaporizer 16 is arranged opposite the spray hole (not illustrated in detail) so that an outlet space 18 for the fuel coming out of injection valve 10 is provided in cylindrical recess 14 between spray hole section 13 and inlet orifice 17.

Between inlet orifice 17 and outlet orifice 19 fuel vaporizer 16 has a vaporization area 20 with a vaporizer structure 21 inside that can be heated by an electric heater 22 surrounding vaporization area 20 and/or heated directly (not illustrated). A heating current power line (not illustrated) for heater 22 can be connected to an appropriate electric power source via a connecting section 23 on housing 15.

Outlet orifice 19 of fuel vaporizer 16 is surrounded by an air blow-out device 24 of an air supply system 25 which is preferably designed as an annular gap nozzle and is connected to an outlet orifice 26 in housing 15 for the fuel-air mixture formed in the area of outlet orifice 19 of fuel vaporizer 16. Outlet orifice 26 has a guide surface 27 arranged on the periphery with respect to fuel stream direction A.

To supply air, preferably compressed air, to the annular gap nozzle 24 that serves as an air blow-out device, an air supply line 28 is provided in housing 15 and can be connected to a suitable compressed air source (e.g. compressed air pump 36) via a suitable connection 29 or by a similar means.

Figure 4:
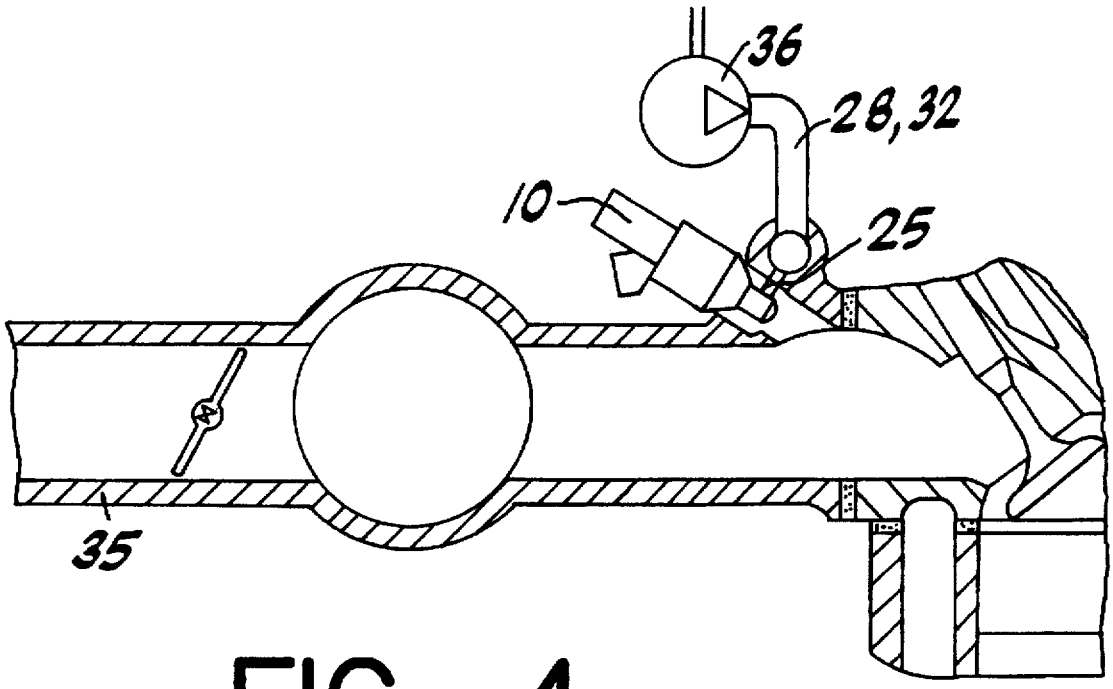
FIG. 4 shows an example of a fuel injection valve cooperating with an air pump and an intake tube, according to the present invention.
Figure 5:
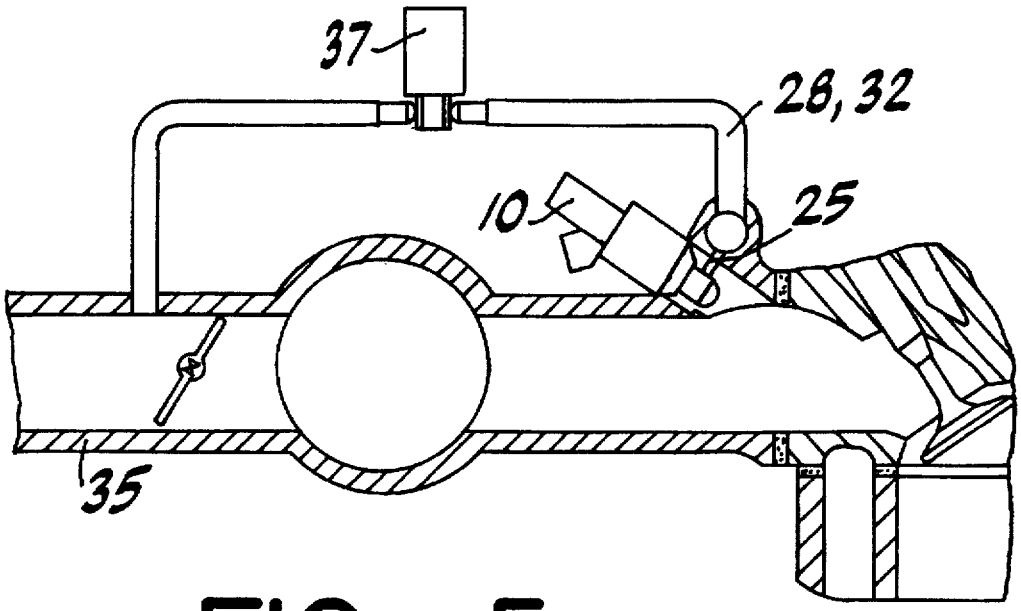
FIG. 5 shows an example of a fuel injection valve cooperating with an idling air regulator and an intake tube, according to the present invention.

As shown in FIGS. 4 and 5 the compressed air source may be, for example, a suitable pump 36 whose intake side is connected to ambient air and whose delivery side is connected to air supply line 28. Preferably, however, air supply line 28 is connected to the intake tube 35 of the combustion engine in which the fuel injection system according to this invention is used so that the air to be mixed with the fuel in the area of outlet orifice 19 of fuel vaporizer 16 is supplied by utilizing the pressure gradient in the intake tube 35.

It is especially possible to connect air supply line 28 to the outlet side of the idling air regulator 37 in such a way that all the idling air is added to the fuel leaving fuel vaporizer 16 during idling. In this case the annular gap nozzle 24 is designed so it does not determine how much air is to be added, because the idling air to regulate the idling operation of the combustion engine is metered by the idling air regulator 37.

Figure 2:
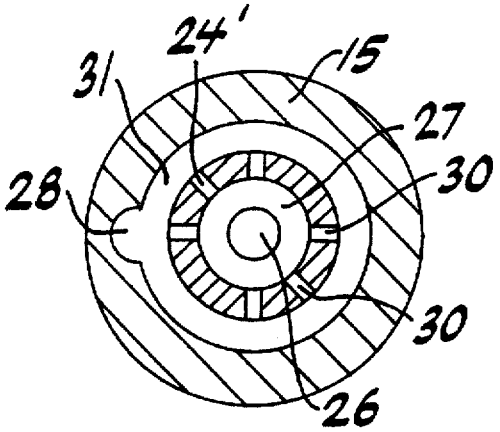
FIG. 2 shows a sectional view essentially according to line II—II in FIG. 1 for another embodiment of this invention.

As illustrated in FIG. 2, air blow-out device 24' may also be provided with several nozzles 30 arranged in a star pattern with respect to fuel stream direction A, preferably distributed evenly in the peripheral direction. The individual nozzles 30 are connected to air supply line 28 via an annular channel 31. In addition to the two embodiments of the air blow-out device shown here, other suitable designs are also possible, such as a sector arrangement of slots.

Immediately after starting a combustion engine, the fuel injection system according to this invention is operated by heating the fuel vaporizer electrically so its vaporizer structure 21 is heated. Fuel injected into vaporization area 20 by injection valve 10 so it comes in contact with vaporizer structure 21 is thus vaporized, so a fuel vapor stream is discharged from fuel vaporizer 16. This fuel vapor stream is shaped by the air blown out of the air blow-out device, namely annular gap nozzle 24 or individual nozzles 30, and mixes with it. This improves the fuel/air mixing for the combustion engine.

After a warm-up period for the combustion engine while the catalyst in the engine's exhaust system is also being heated to its operating temperature, it is no longer necessary to heat fuel vaporizer 16, so its heating system can be turned off.

With the heating system of fuel vaporizer 16 not in operation, in other words, when vaporizer structure 21 has cooled off, vaporization of fuel is essentially no longer taking place in vaporization area 20 and a fuel stream is discharged from outlet orifice 19. The air supplied by the air blow-out device can be accelerated to the velocity of sound if annular gap nozzle 24 or individual nozzles 24' are designed suitably and it is responsible for atomization of the fuel delivered, while at the same time the fuel delivery from fuel vaporizer 16 is improved by a suction effect of the air discharged. This suction effect greatly reduces fuel deposits on vaporizer structure 21.

Figure 3:
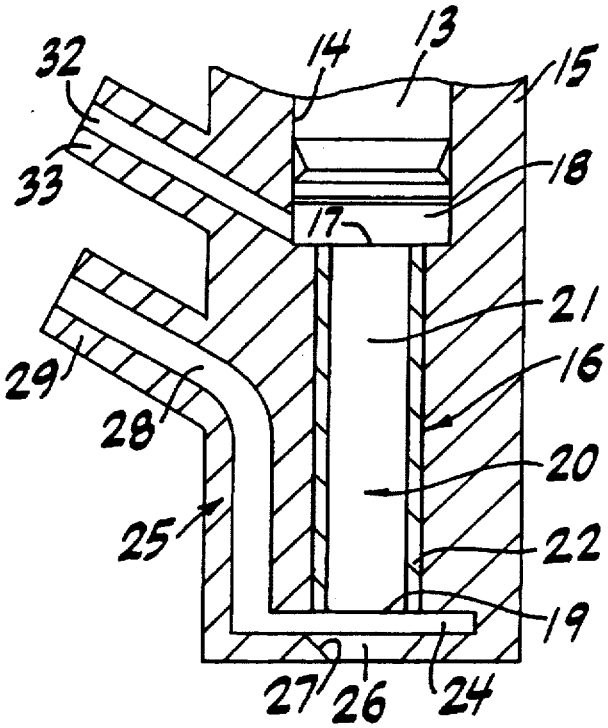
FIG. 3 shows a schematic sectional view through a fuel vaporizer according to another embodiment of this invention.

To prevent fuel deposits in fuel vaporizer 16 almost completely in addition to achieving improved atomization of the fuel leaving vaporizer 16 and the shaping of the fuel stream, a second air supply line 32 that is provided in the embodiment of this invention illustrated in FIG. 3 can also be connected to an air source via a connection 33. Air supply line 32 opens into outlet space 18 which in turn opens between spray hole section 13 of injection valve 10 and inlet orifice 17 of fuel vaporizer 16.

During operation of the injection system according to this invention, the air supplied to outlet space 18 through the second air inlet line 32 is sent together with the fuel delivered from injection valve 10 through vaporization area 20 of fuel vaporizer 16. In the process, this air causes any droplets of fuel that might have been deposited on vaporizer structure 21 to be entrained again while heating system 22 of fuel vaporizer 16 is turned off, so the fuel vaporizer is purged by this additional air.

Together with the air supplied in the area of outer orifice 19 of fuel vaporizer 16 which causes a suction effect there, a great improvement in fuel delivery is thus achieved, while at the same time fuel deposits in fuel vaporizer 16 that could have a negative effect on fuel delivery are prevented almost completely, thus making it possible to achieve accurate metering of fuel for forming the mixture.

What is claimed is:

1. A fuel injection system for an internal combustion engine comprising:

an injection valve;

a fuel vaporizer having an inlet orifice for receiving fuel from the injection valve, the fuel vaporizer further having an outlet orifice for emitting a fuel stream; and an air supply system delivering air to the fuel stream for mixing with the fuel stream of the fuel vaporizer, the air supply system including a first air blow-out device positioned in close proximity to the outlet orifice, the air being delivered through the first air blow-out device for mixing with the fuel stream at the outlet orifice.

2. The fuel injection system according to claim 1 wherein the first air blow-out device includes a nozzle.

3. The fuel injection system according to claim 2 wherein the nozzle has a plurality of individual bores.

4. The fuel injection system according to claim 3 wherein the plurality of individual bores are arranged in a predetermined pattern.

5. The fuel injection system according to claim 4 wherein the plurality of individual bores includes eight individual bores and the predetermined pattern is an eight element pattern, the eight elements approximately evenly spaced.

6. The fuel injection system according to claim 2 wherein the nozzle is an annular gap nozzle.

7. The fuel injection system according to claim 2 wherein the fuel stream is emitted in a first direction and wherein the air is delivered in a second direction, the second direction being approximately radial to the first direction.

8. The fuel injection system according to claim 2 wherein the nozzle has a predetermined cross section that regulates an amount of air to be mixed with the fuel stream.

9. The fuel injection system according to claim 1 wherein the air supply system further includes a second air blow-out device disposed adjacent to the inlet orifice of the fuel vaporizer.

10. The fuel injection system according to claim 1 wherein the air supply system further includes an air supply line coupled to an intake tube of the internal combustion engine.

11. The fuel injection system according to claim 10 wherein the air supply line is coupled to the intake tube via an idling air regulator.

12. The fuel injection system according to claim 10 wherein the air supply line has an intake end coupled to a compressed air pump.

* * * * *